US010474064B2

(12) United States Patent
Suzuki

(10) Patent No.: US 10,474,064 B2
(45) Date of Patent: Nov. 12, 2019

(54) DEVELOPING APPARATUS

(71) Applicant: CANON KABUSHIKI KAISHA, Tokyo (JP)

(72) Inventor: Hideaki Suzuki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/212,816

(22) Filed: Dec. 7, 2018

(65) Prior Publication Data

US 2019/0187588 A1 Jun. 20, 2019

(30) Foreign Application Priority Data

Dec. 18, 2017 (JP) ..... 2017-242136

(51) Int. Cl.
*G03G 15/08* (2006.01)

(52) U.S. Cl.
CPC . *G03G 15/0887* (2013.01); *G03G 2215/0822* (2013.01)

(58) Field of Classification Search
CPC ..... G03G 15/0891; G03G 15/0865; G03G 15/0887; G03G 15/0877; G03G 2215/0822
USPC ..... 399/262
See application file for complete search history.

(56) References Cited

U.S. PATENT DOCUMENTS 8,750,764 B2 * 6/2014 Okuno ..... G03G 15/0189 399/254
9,459,558 B1 10/2016 Onuki et al.
2018/0341196 A1 * 11/2018 Saito ..... G03G 15/0891

FOREIGN PATENT DOCUMENTS

JP 2005-221852 A 8/2005
JP 2016-206325 A 12/2016

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

A developing apparatus includes a developer carrier configured to carry developer, a developer container having a first chamber and a second chamber, a first conveying member provided in the first chamber, and including a first conveying unit and, on a downstream side in a first direction, a reverse conveying unit, a second conveying member, a discharge unit configured to discharge the developer, and a partition wall having a first communication port and a second communication port and configured to partition the first chamber and the second chamber. In addition, a plurality of protruding portions are provided so as to oppose the first conveying member at a position above a region between the first conveying unit and the reverse conveying unit in a vertical direction, each of the protruding portions extending along the first direction, wherein the plurality of protruding portions are arranged in a row in a direction orthogonal to the first direction.

10 Claims, 10 Drawing Sheets

DEVELOPING APPARATUS

BACKGROUND OF THE INVENTION

Field of the Invention

The present invention relates to a developing apparatus preferably used for an image forming apparatus, such as a printer, a copier, a facsimile or a multifunction device, which uses an electrophotographic technique.

Description of the Related Art

An image forming apparatus includes a developing apparatus which develops an electrostatic latent image formed on a photosensitive drum with developer so as to visualize the electrostatic latent image. The developing apparatus uses a two-component developer made of a non-magnetic toner and a magnetic carrier. A carrier in the two-component developer (simply referred to as "developer") degrades with the repeated usage of the developer for a long period of time. When the degraded carrier is continuously used, the charge amount of toner in the developer is lowered so that the developer with the lowered charge amount of toner easily causes image defects, such as fogging, or smudging in the apparatus due to toner scattering. In view of the above, to suppress the lowering of the charge amount of toner, a developing apparatus is proposed which has the ACR configuration where, in replenishing a toner of an amount substantially equal to an amount of toner consumed in image forming, an excess developer containing a degraded carrier is discharged through a discharge port while new carrier is replenished (Japanese Patent Application Laid-Open No. 2005-221852). In the developing apparatus having the ACR (Auto Carrier Refresh) configuration, of developer conveyed toward the discharge port side by a conveying screw, a portion of the developer reaching the discharge port against a push-back force of a reverse screw is discharged to the outside of the developer container. By discharging the developer in this manner, an amount of developer (referred to as "developer amount") in the developer container is adjusted so as not to become excessively large.

In the case of the apparatus described in Japanese Patent Application Laid-Open No. 2005-221852, there may be a case where developer is continuously discharged little by little through a discharge port even when there is only a small developer amount in the developer container, thus causing the developer amount in the developer container to be lowered excessively. This is because airflow is generated in the developer container with the rotation of the conveying screw, and developer spattered by the conveying screw is conveyed to the discharge port side on the airflow, and is discharged. This airflow is generated regardless of a developer amount in the developer container and hence, the developer may be discharged even if a developer amount is small. To suppress the discharge of developer due to airflow generated with the rotation of the conveying screw, a configuration is proposed where a wall is provided so as to extend in the direction intersecting with the direction along which the conveying screw conveys the developer, thus blocking the airflow with this wall (Japanese Patent Application Laid-Open No. 2016-206325).

In the case of the above-mentioned apparatus described in Japanese Patent Application Laid-Open No. 2016-206325, along with the increase in developer amount due to the replenishment, the surface (referred to as "developer surface") of the developer to be conveyed by the conveying screw becomes higher in level than a lowest end of the above-mentioned wall and hence, the developer interferes with the wall in some cases. In such a case, conveyance of the developer by the conveying screw is obstructed by the wall so that the developer easily accumulates. Accordingly, there is a possibility that the discharge of the developer through the discharge port is obstructed, thus causing an excessively large developer amount in the developer container.

SUMMARY OF THE INVENTION

It is an object of the present invention to provide a developing apparatus which can suppress the discharge of developer through a developer discharge port due to airflow.

According to the present invention, there is provided a developing apparatus including: a developer carrier configured to carry developer; a developer container having a first chamber and a second chamber which forms a circulation passage for the developer in cooperation with the first chamber; a first conveying member provided in the first chamber, and including a first conveying unit and, on a downstream side in a first direction, a reverse conveying unit, the first conveying unit being configured to convey the developer in the first direction, and the reverse conveying unit being configured to convey the developer in a second direction opposite to the first direction; a second conveying member provided in the second chamber, and configured to convey the developer in the second direction; a discharge unit provided in the first chamber at a position on a downstream side of the reverse conveying unit in the first direction, and configured to discharge the developer; a partition wall having a first communication port and a second communication port, and configured to partition the first chamber and the second chamber, the developer being delivered from the first chamber to the second chamber through the first communication port, and the developer being delivered from the second chamber to the first chamber through the second communication port; and a plurality of protruding portions provided so as to oppose the first conveying member at a position above a region between the first conveying unit and the reverse conveying unit in a vertical direction, each of the protruding portions extending along the first direction, wherein the plurality of protruding portions are arranged in a row in a direction orthogonal to the first direction.

Further features of the present invention will become apparent from the following description of exemplary embodiments with reference to the attached drawings.

BRIEF DESCRIPTION OF THE DRAWINGS

FIG. 7A, FIG. 7B and FIG. 7C are views illustrating a wall member in a second embodiment, wherein FIG. 7A is a schematic view as viewed from the upstream side in the first direction, FIG. 7B is a schematic view as viewed from a side surface side, and FIG. 7C is a schematic view as viewed from the downstream side in the first direction.

DESCRIPTION OF THE EMBODIMENTS

Preferred embodiments of the present invention will now be described in detail in accordance with the accompanying drawings.

First Embodiment

A first embodiment is described with reference to FIG. 1 to FIG. 6. First, a schematic configuration of an image forming apparatus to which a developing apparatus of this embodiment is applied is described with reference to FIG. 1 and FIG. 2.

<Image Forming Apparatus>

Figure 1:
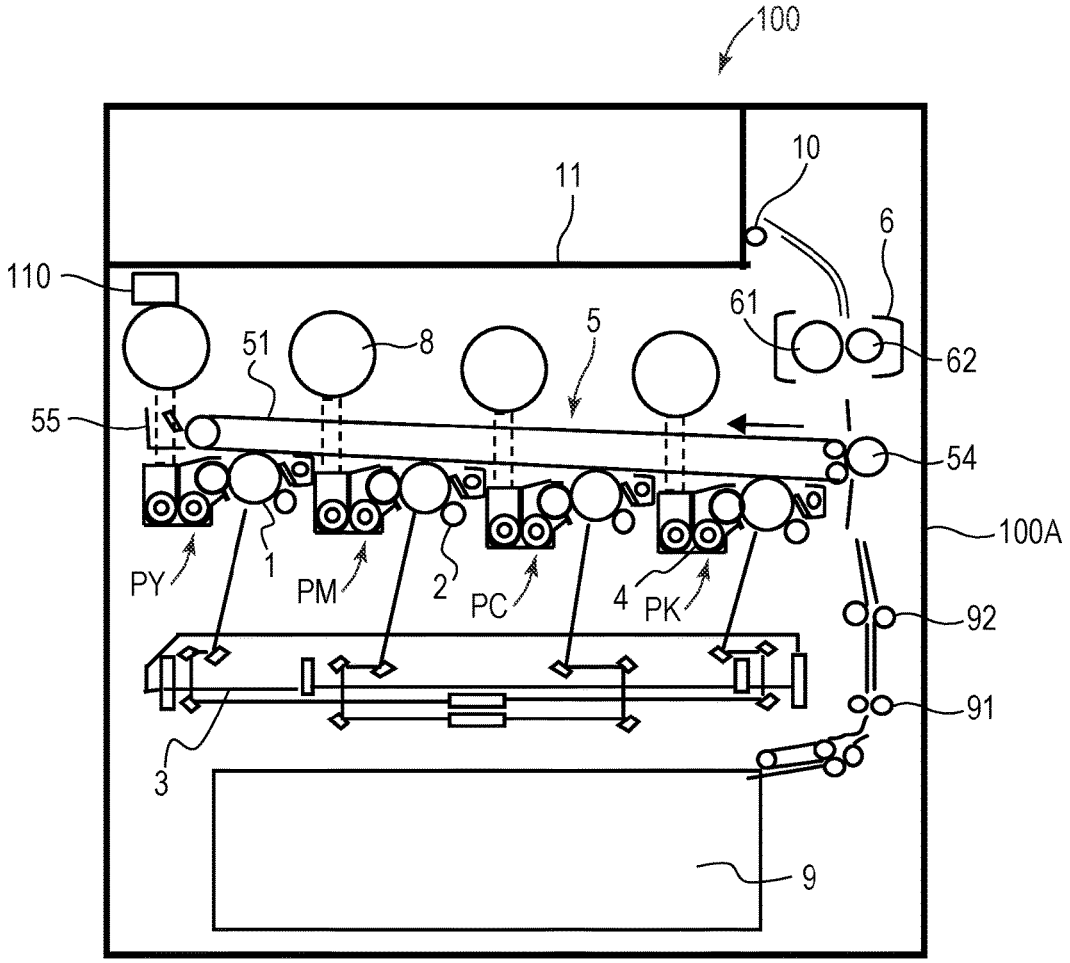
FIG. 1 is a schematic view illustrating the configuration of an image forming apparatus to which a developing apparatus of this embodiment is applied.

An image forming apparatus 100 illustrated in FIG. 1 is an electrophotographic full color image forming apparatus of a tandem type. The image forming apparatus 100 includes image forming units PY, PM, PC and PK which respectively form images of yellow, magenta, cyan and black. The image forming apparatus 100 can perform image forming on a recording material in response to an image signal from external equipment (not illustrated in the drawing), such as a personal computer, which is communicably coupled to an original reader (not illustrated in the drawing) coupled to an apparatus main body 100A or to the apparatus main body 100A. The recording material may be a sheet material, such as a paper, a plastic film or cloth.

The image forming units PY to PK have substantially the same configuration except that the image forming units PY to PK have different developing colors. Accordingly, in this embodiment, the image forming unit PK is described as a representative of the image forming unit, and the description of other image forming units is omitted.

Figure 2:
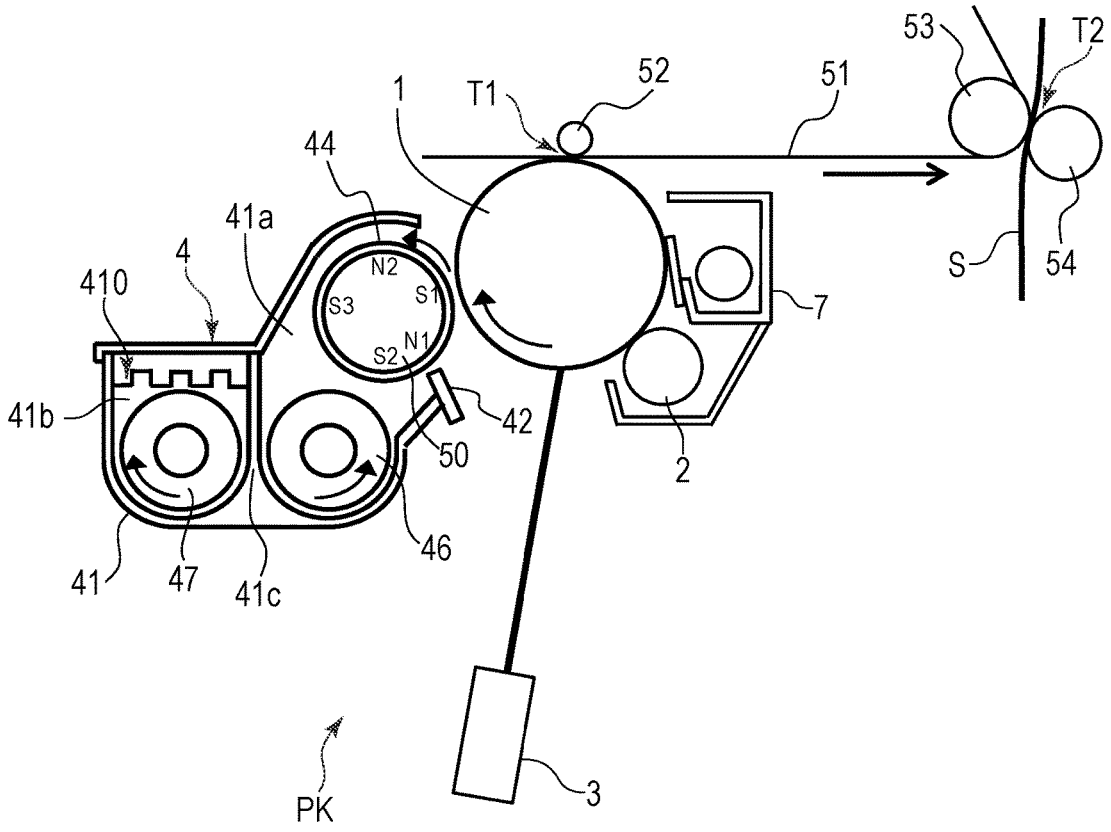
FIG. 2 is a schematic view illustrating an image forming unit and an area around the image forming unit.

As illustrated in FIG. 2, a photosensitive drum 1 is provided to the image forming unit PK. The photosensitive drum 1 is rotationally driven in a direction indicated by the arrow in the drawing. A charging apparatus 2, an exposure apparatus 3 (laser scanner, for example), a developing apparatus 4, primary transfer roller 52, and a cleaner 7 are disposed around the photosensitive drum 1.

As illustrated in FIG. 1, an intermediate transfer apparatus 5 is disposed above the image forming unit PK in the vertical direction. The intermediate transfer apparatus 5 is configured such that an endless intermediate transfer belt 51 is made to extend between a plurality of rollers, and travels in the direction indicated by the arrow. As illustrated in FIG. 2, a secondary transfer roller 54 is disposed at a position which opposes the roller 53, which causes the intermediate transfer belt 51 to extend, with the intermediate transfer belt 51 interposed therebetween, thus forming a secondary transfer unit T2 which transfers a toner image on the intermediate transfer belt 51 to a recording material. As illustrated in FIG. 1, a fixing apparatus 6 is disposed on the downstream of the secondary transfer unit T2 in the recording material conveying direction.

A cassette 9 is disposed at a lower portion of the image forming apparatus 100, and a recording material is accommodated in the cassette 9. A recording material fed from the cassette 9 is conveyed by a conveying roller 91 toward a registration roller 92. The registration roller 92 in a stopped state corrects the skewing of the recording material by a distal end of the recording material abutting on the registration roller 92. Thereafter, the registration roller 92 is caused to start rotating in synchronization with a toner image on the intermediate transfer belt 51, thus conveying the recording material to the secondary transfer unit T2.

The description is made with respect to a process for forming a full four color image, for example, with the image forming apparatus 100 having the above-mentioned configuration. When an image forming operation is started, first, a surface of the rotating photosensitive drum 1 is uniformly charged by the charging apparatus 2. Next, the photosensitive drum 1 is scanned and exposed with a laser beam corresponding to an image signal outputted from the exposure apparatus 3. With such operations, an electrostatic latent image corresponding to the image signal is formed on the photosensitive drum 1. The electrostatic latent image on the photosensitive drum 1 is formed into a visible image by a toner accommodated in the developing apparatus 4, thus being formed into a visible image.

The toner image formed on the photosensitive drum 1 is primarily transferred onto the intermediate transfer belt 51 at a primary transfer unit T1 formed between the photosensitive drum 1 and the primary transfer roller 52, which is disposed with the intermediate transfer belt 51 interposed therebetween. In performing the primary transfer, a primary transfer bias is applied to the primary transfer roller 52. Deposits, such as toner, remaining on a surface of the photosensitive drum 1 after the primary transfer is performed are removed by the cleaner 7.

Such operations are sequentially performed in the respective image forming units PY to PK of yellow, magenta, cyan and black, and toner images of four colors are made to overlap with each other on the intermediate transfer belt 51. Thereafter, a recording material accommodated in the cassette 9 is conveyed to the secondary transfer unit T2 in synchronization with toner image forming timing. Then, a secondary transfer bias is applied to the secondary transfer roller 54, thus secondarily transferring the toner images of four colors collectively on the intermediate transfer belt 51 onto the recording material. Deposits, such as toner, which are not transferred at the secondary transfer unit T2 thus remaining on the intermediate transfer belt 51 are removed by an intermediate transfer belt cleaner 55 illustrated in FIG. 1.

Next, the recording material is conveyed to the fixing apparatus 6. The fixing apparatus 6 includes a fixing roller 61 and a pressing roller 62, and the fixing roller 61 and the pressing roller 62 form a fixing nip portion. The fixing roller 61 may be formed of a film or a belt, and the pressing roller 62 may be formed of a belt. Causing the recording material, to which toner images are transferred, to pass through the fixing nip portion allows the recording material to be heated and pressed. Then, the toners on the recording material are fused and mixed, thus being fixed to the recording material as a full color image. Thereafter, the recording material is discharged to a discharge tray 11 by a discharge roller 10. A series of image forming processes is completed in this manner.

The image forming apparatus 100 of this embodiment may also form a monochrome image or a multicolor image, such as a monochrome black image, using the image forming unit of a desired monochrome color or some of the image forming units PY to PK of four colors, for example.

<Developing Apparatus>

The developing apparatus 4 in this embodiment is described with reference to FIG. 2 to FIG. 4. As illustrated in FIG. 2, the developing apparatus 4 includes a developer container 41 which accommodates a two-component developer containing a non-magnetic toner and a magnetic carrier. The amount of developer which is already accommodated in the developer container 41 may drop with the developing operation of the developing apparatus 4, and may increase with the developer replenishing operation performed by a replenishing apparatus 8 described later (see FIG. 1).

The developer container 41 has an opening at a portion which opposes the photosensitive drum 1, and corresponds to a developing region. A developing sleeve 44 is installed in a rotatable manner such that a portion of the developing sleeve 44 is exposed at this open portion. In the inside of the developing sleeve 44, a magnet roll 50 is disposed in a non-rotatable manner, and the magnet roll 50 has a plurality of magnetic poles along the circumferential direction. The developing sleeve 44 is made of a non-magnetic material. The developing sleeve 44 rotates in a direction indicated by the arrow in FIG. 2 during the developing operation so as to carry and convey developer in the developer container to the developing region.

The developing apparatus 4 has a developing chamber 41*a* as a second chamber and a stirring chamber 41*b* as a first chamber in the developer container, and the developing chamber 41*a* and the stirring chamber 41*b* can accommodate a developer. The developing chamber 41*a* and the stirring chamber 41*b* form a circulation passage which allows developer to circulate therethrough. That is, the inside of the developer container 41 is divided into the developing chamber 41*a* and the stirring chamber 41*b* by a partition wall 41*c*. As illustrated in FIG. 3, the developing chamber 41*a* and the stirring chamber 41*b* communicate with each other through a second communication port 41*f* and a first communication port 41*g*. The second communication port 41*f* and the first communication port 41*g* are formed on both end portions (a left end and a right end in FIG. 3) of the partition wall 41*c* in the longitudinal direction so as to deliver developer between the developing chamber 41*a* and the stirring chamber 41*b*.

Figure 3:
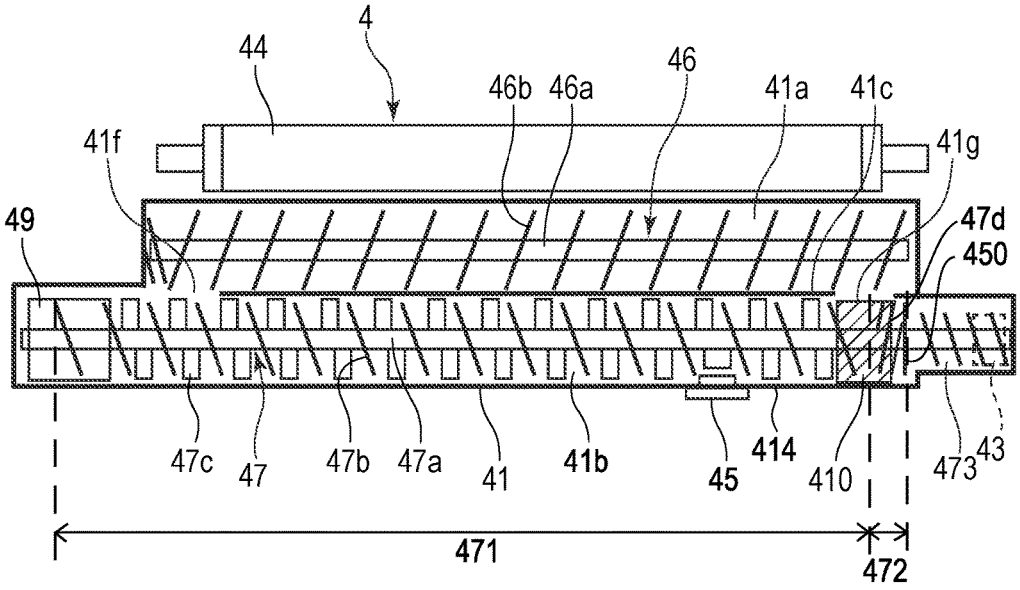
FIG. 3 is a cross-sectional view of the developing apparatus of a first embodiment as viewed from above in the vertical direction.

As illustrated in FIG. 3, a developing screw 46 and a stirring screw 47, each of which conveys developer, are respectively provided to the developing chamber 41*a* and the stirring chamber 41*b* in a rotatable manner. Each of the developing screw 46 and the stirring screw 47 is a screw made of a resin with a spiral blade 46*b*, 47*b* formed on a peripheral surface of a rotary shaft 46*a*, 47*a*.

A reverse blade 47*d* is provided to the stirring screw 47 as a conveying member (conveying screw), and the reverse blade 47*d* conveys developer in the direction opposite to the direction along which the forward blade 47*b* conveys developer. That is, the stirring screw 47 includes a screw 471 as a conveying unit on which the blade 47*b* is formed, and a reverse screw 472 as a reverse conveying unit on which the blade 47*d* is formed. The reverse screw 472 is disposed in the stirring screw 47 such that the reverse screw 472 is positioned on the upstream side of a discharge port 43 in a developer conveying direction along which the screw 471 conveys developer (on the upstream side in the first direction). Setting the pitch of the blade 47*d* of the reverse screw 472 smaller than the pitch of the blade 47*b* of the screw 471 so as to increase the number of blades per unit length allows the reverse screw 472 to have a stronger force to push back developer. Further, a disk shaped member 450 is provided at a downstream end 472*a* of the reverse screw 472 in the first direction so as to prevent developer from passing through a gap formed between the blade 47*d* and an inner wall surface of the developer container 41.

In a plurality of intervening areas on the screw 471 between pitch intervals of the blade 47*b*, ribs 47*c* projecting in the radial direction are formed at least at positions which oppose an inductance sensor 45. The inductance sensor 45 detects toner concentration in a developer. In this embodiment, the ribs 47*c* are formed on the screw 471 at portions except for at both ends of the screw 471. That is, the screw 471 includes the blade 47*b* and the ribs 47*c* as a plurality of projecting portions which have different developer conveying capacities in the circumferential direction. The ribs 47*c* stir developer in the circumferential direction of the screw 471 with the rotation of the stirring screw 47, thus causing toner concentration in the developer to become uniform.

Figure 4:
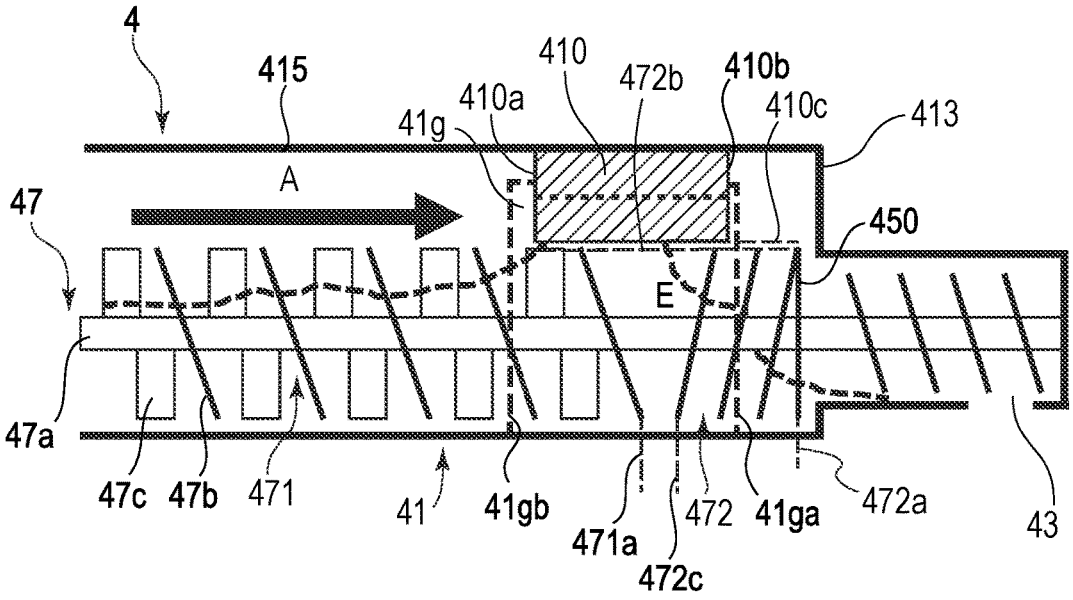
FIG. 4 is a schematic view illustrating an area in the vicinity of a first communication port when the developing apparatus of the first embodiment is viewed from the stirring chamber side.

In the case of this embodiment, as illustrated in FIG. 4, an upstream end 472*c* of the reverse screw 472 is disposed on the downstream side of an upstream end 41*gb* of the first communication port 41*g* in the first direction. Further, the stirring screw 47 is disposed such that, in the first direction, both a downstream end 471*a* of the screw 471 and the upstream end 472*c* of the reverse screw 472 are positioned between the upstream end 41*gb* and a downstream end 41*ga* of the first communication port 41*g*. With such a configuration, delivery of developer through the first communication port 41*g* can be smoothly performed. That is, in a region between the downstream end 471*a* of the screw 471 and the upstream end 472*c* of the reverse screw 472 (referred to as "peak region"), the surface of developer is maintained in a relatively high level. This is because developer conveyed in the first direction by the screw 471 and developer conveyed in the direction (second direction) opposite to the first direction by the reverse screw 472 collide with each other, thus forming a crest of developer. Further, in a state where the surface of the developer is at a relatively high level, a developer amount per unit length in the first direction is larger than other portions. Accordingly, causing the peak region to be positioned between the upstream end 41*gb* and the downstream end 41*ga* of the first communication port 41*g* allows developer to be smoothly delivered through the first communication port 41*g*.

The stirring screw 47 and the developing screw 46 are disposed so as to remain parallel to the developing sleeve 44, and are also disposed so as to be parallel to the direction of an axis of rotation of the photosensitive drum 1 (see FIG. 2). The developing sleeve 44, the stirring screw 47 and the developing screw 46 are rotationally driven by a motor not illustrated in the drawing. For example, both the stirring screw 47 and the developing screw 46 are rotated at a rotational speed of 692 rpm. Developer in the developing chamber 41*a* is moved from the right side to the left side (in the second direction) in FIG. 3 while being stirred by the rotating developing screw 46, thus being delivered to the stirring chamber 41*b* through the second communication port 41*f* On the other hand, developer in the stirring chamber 41*b* is moved from the left side to the right side (in the first direction) in FIG. 3 while being stirred by the rotating screw 471, thus being delivered to the developing chamber 41*a* through the first communication port 41*g* as a communication port. In this manner, developer is conveyed in a circulating manner in the developer container while being stirred by the two screws of the stirring screw 47 and the developing screw 46.

As illustrated in FIG. 2, developer to be conveyed in the developing chamber 41*a* is supplied to the developing sleeve 44 by the developing screw 46. A predetermined amount of the developer supplied to the developing sleeve 44 is carried on the developing sleeve 44 by a magnetic field of the magnet roll 50, thus forming a developer reservoir. With the rotation of the developing sleeve 44, the developer on the developing sleeve 44 passes through the developer reservoir, and a layer thickness of the developer is regulated by a restricting member 42 and, at the same time, the developer is conveyed to the developing region where the developer opposes the photosensitive drum 1.

In the above-mentioned developing region, the developer on the developing sleeve 44 causes napping, thus forming a magnetic brush. The magnetic brush is caused to come into contact with the photosensitive drum 1 so as to supply a toner in the developer to the photosensitive drum 1, thus developing an electrostatic latent image on the photosensitive drum 1 as a toner image. A developing bias, where a DC voltage and an AC voltage are superimposed on each other, is applied to the developing sleeve 44. The developer remaining on the developing sleeve 44 after the toner is supplied to the photosensitive drum 1 returns to the developing chamber 41*a* with the further rotation of the developing sleeve 44.

As illustrated in FIG. 3, the discharge port 43 is formed in the stirring chamber 41*b* on the downstream end portion side (right end portion side in FIG. 3) of the stirring screw 47 in the first direction, and the discharge port 43 discharges a portion of the developer (excess developer) in the developer container therethrough. Developer which is conveyed in the stirring chamber 41*b* by the stirring screw 47, and flows beyond the reverse screw 472 is discharged through the discharge port 43. The discharge port 43 is formed in a bottom surface of the developer container 41, and developer dropping into the discharge port 43 is discharged to the outside of the developer container. The developer discharged through the discharge port 43 is collected to a collection container not illustrated in the drawing.

On the other hand, a replenishing opening 49 is formed in the stirring chamber 41*b* on an upstream end portion side (a left end portion side in FIG. 3) of the stirring screw 47 in the first direction, and the replenishing opening 49 receives a replenishing developer (referred to as "replenishing agent") which is replenished from the replenishing apparatus 8 (see FIG. 1). As illustrated in FIG. 1, the replenishing apparatuses 8 are disposed above the developing apparatuses 4 of the respective image forming units, and can replenish developer to the developing apparatuses 4 of the respective image forming units. Each replenishing apparatus 8 accommodates a replenishing agent containing a toner and a carrier. The replenishing apparatus 8 replenishes a replenishing agent by appropriately rotating a replenish screw not illustrated in the drawing according to a usage amount of toner which is used during image formation or according to a toner concentration detected by the inductance sensor 45 (see FIG. 3). The replenishing agent is developer obtained by mixing a toner and a carrier at a ratio of 9 to 1 by weight, for example.

The replenishing agent replenished into the stirring chamber 41*b* is conveyed in the stirring chamber 41*b* while being stirred by the screw 471 together with developer conveyed from the developing chamber 41*a*. An excess developer which may be generated with the replenishment of a replenishing agent is discharged through the discharge port 43 as described previously. When the excess developer is discharged, a degraded carrier is also discharged. That is, the developing apparatus 4 in this embodiment is a developing apparatus having the ACR configuration where a replenishing agent containing a large amount of toner is replenished from the replenishing apparatus 8 and, at the same time, an excess developer containing a large amount of degraded carrier is discharged through the discharge port 43.

In this embodiment, a discharge unit 473 is provided on the downstream side in the first direction of the reverse screw 472 in the stirring chamber 41*b*. A discharge screw is disposed in the discharge unit 473. The discharge screw conveys, in the first direction, developer flowing beyond the reverse screw 472, thus allowing the developer to be efficiently discharged through the discharge port 43 which can discharge the developer therethrough.

Figure 10:
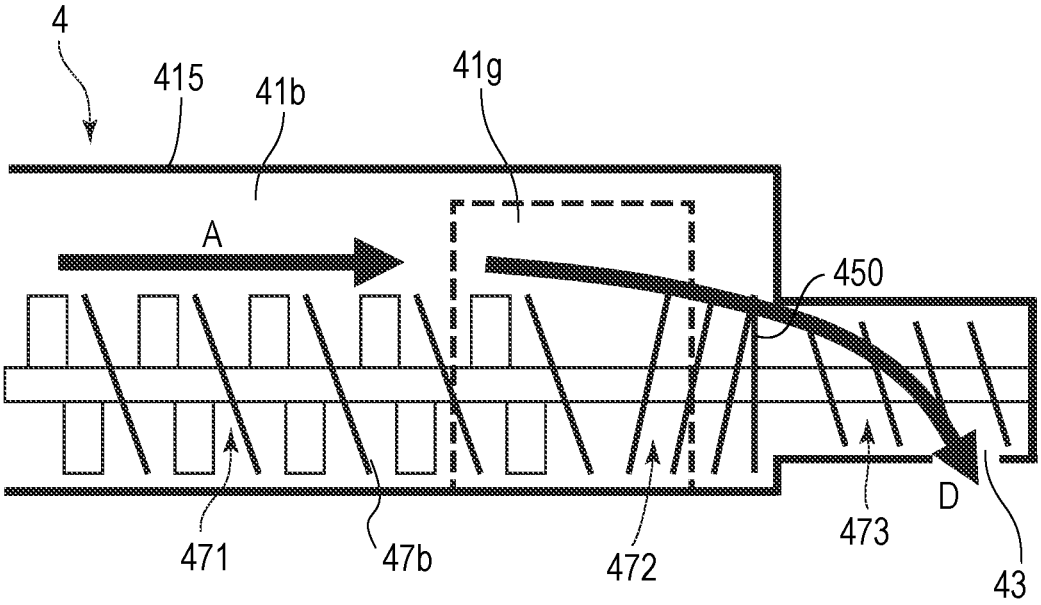
FIG. 10 is a schematic view illustrating an area in the vicinity of a first communication port when a conventional developing apparatus is viewed from the stirring chamber side.

On the other hand, in the conventional developing apparatus, as described previously, there may be a case where developer is discharged not only in the case where the developer amount in the developer container is increased with the replenishment of a replenishing agent but also in the case where the developer amount in the developer container is small. FIG. 10 illustrates the conventional developing apparatus.

In the case of the developing apparatus illustrated in FIG. 10, a small developer amount brings about a state where the blade 47*b* of the screw 471 is exposed from developer so that the developer is easily spattered upward in the vertical direction by the rotating blade 47*b*. Particularly, with higher rotational speed of the screw 471, the developer is spattered to a greater height. In a state where the blade 47*b* is exposed from the developer, air is pushed by the blade 47*b* with the rotation of the blade 47*b* so that the air flows in the first direction in the stirring chamber 41*b*, thus generating an airflow A. The airflow A is proportional to the rotational speed of the screw 471. Accordingly, with higher rotational speed of the screw 471, the airflow A becomes larger (stronger).

A portion of the airflow A flows into the developing chamber 41*a* from the stirring chamber 41*b* through the first communication port 41*g* (see FIG. 3). However, most of the airflow A flows in the stirring chamber 41*b* toward the downstream side in the first direction (airflow D) without passing through the first communication port 41*g* (that is, without flowing into the developing chamber 41*a*). Accordingly, the developer which is spattered by the blade 47*b* and is conveyed by the airflow A (airflow D) flows beyond the reverse screw 472 and is discharged through the discharge port 43.

As described above, conventionally, also in the case where the developer amount in the developer container is small, developer may be discharged by the above-mentioned airflow little by little. Accordingly, there is a possibility that the developer amount in the developer container becomes excessively small, thus causing image defects, such as a defect that an image is partially missing due to insufficient supply of developer to the developing sleeve 44. However, developer is conveyed with the rotation of the screw 471 and hence, the above-mentioned airflow is generated in any case. In view of the above, in this embodiment, on the premise that airflow is generated with the rotation of the screw 471, a wall member 410 which blocks the airflow is provided to the stirring chamber 41*b* so as to prevent developer from being easily discharged through the discharge port 43 even if the developer is conveyed by the airflow. Hereinafter, the wall member 410 is described with reference to FIG. 3 to FIG. 5. In the description made hereinafter, unless otherwise specified, "upstream" and "downstream" respectively means the upstream in the first direction and the downstream in the first direction.

<Wall Member>

In the developing apparatus 4 in this embodiment, the wall member 410 is provided to the stirring chamber 41*b*. Although described later more specifically, the wall member 410 in this embodiment is formed such that a plurality of block wall portions 411, acting as protruding portions, which block airflow are disposed with gaps 412 therebetween in the width direction (described later. See FIG. 5). Developer can enter the gaps 412 according to the surface level of the developer to be conveyed with the rotation of the stirring screw 47. The gaps 412 are described later. First, blockage of airflow with the wall member 410 (to be more specific, the block wall portions 411 described later) is described.

As illustrated in FIG. 3, the wall member 410 is provided in the stirring chamber 41*b* so as to transversally extend from the partition wall 41*c* to an opposing wall portion 414 of the developer container 41 on the side opposite to the partition wall 41*c* in a width direction which intersects with the direction of an axis of rotation of the stirring screw 47. Further, as illustrated in FIG. 4, the wall member 410 is provided such that an upstream end 410*a* is positioned between the upstream end 41*gb* and the downstream end 41*ga* of the first communication port 41*g*. Such a configuration is adopted for allowing airflow which is blocked by the wall member 410 to easily escape to the developing chamber 41*a* from the stirring chamber 41*b* through the first communication port 41*g* (see FIG. 3).

It is preferable that the wall member 410 be disposed between the downstream end 471*a* of the screw 471 and the upstream end 472*c* of the reverse screw 472. In other words, it is preferable that the wall member 410 be disposed so as to overlap with at least the peak region between the downstream end 471*a* of the screw 471 and the upstream end 472*c* of the reverse screw 472 as viewed from above in the vertical direction. A downstream end 410*b* of the wall member 410 may be positioned on the downstream side of the downstream end 41*ga* of the first communication port 41*g*. However, to cause the wall member 410 to be separate from a downstream side wall portion 413 of the developer container 41, the downstream end 410*b* of the wall member 410 is positioned on the upstream side of the downstream side wall portion 413 of the developer container 41.

As illustrated in FIG. 4, the wall member 410 is provided above the stirring screw 47 in the vertical direction with a gap between a lower end portion 410*c* and an upper end portion 472*b* of the stirring screw 47 so as to prevent interference between the wall member 410 and the stirring screw 47. In this embodiment, the wall member 410 is provided so as to extend downward in the vertical direction from an upper wall portion 415 of the developer container 41 while being prevented from overlapping with the blade 47*b* and the ribs 47*c* of the screw 471, and the blade 47*d* of the reverse screw 472 as viewed from the direction of the axis of rotation of the stirring screw 47. To be more specific, the wall member 410 is provided with a gap of approximately 0.5 to 2 mm formed between the lower end portion 410*c* and the upper end portion 472*b* of the stirring screw 47. For example, the wall member 410 is provided with a gap of 1.5 mm at the closest position to the stirring screw 47.

Also in the case of this embodiment where such a wall member 410 is provided, in the same manner as the conventional technique, the airflow A may be generated in the first direction with the rotation of the stirring screw 47, and developer spattered by the blade 47*b* may be conveyed to the downstream side on the airflow A. In the case of this embodiment, the above-mentioned wall member 410 is provided in the advancing direction of the airflow A and hence, the airflow A may impinge on the wall member 410 (to be more specific, the block wall portion 411). Causing the airflow A to impinge on the wall member 410 allows the airflow A to easily flow into the developing chamber 41*a* from the stirring chamber 41*b* through the first communication port 41*g* (see FIG. 3). At this point of operation, a portion of the developer conveyed on the airflow A may flow into the developing chamber 41*a* from the stirring chamber 41*b*. Further, a portion of the developer may impinge on the wall member 410, thus falling by gravity. As described above, in the case of this embodiment, developer conveyed by the airflow A is prevented from easily reaching a position on the downstream side of the wall member 410. Therefore, in the case where a developer amount in the developer container is small, it is possible to prevent that developer is continuously discharged from the discharge port 43 little by little.

Figure 5:
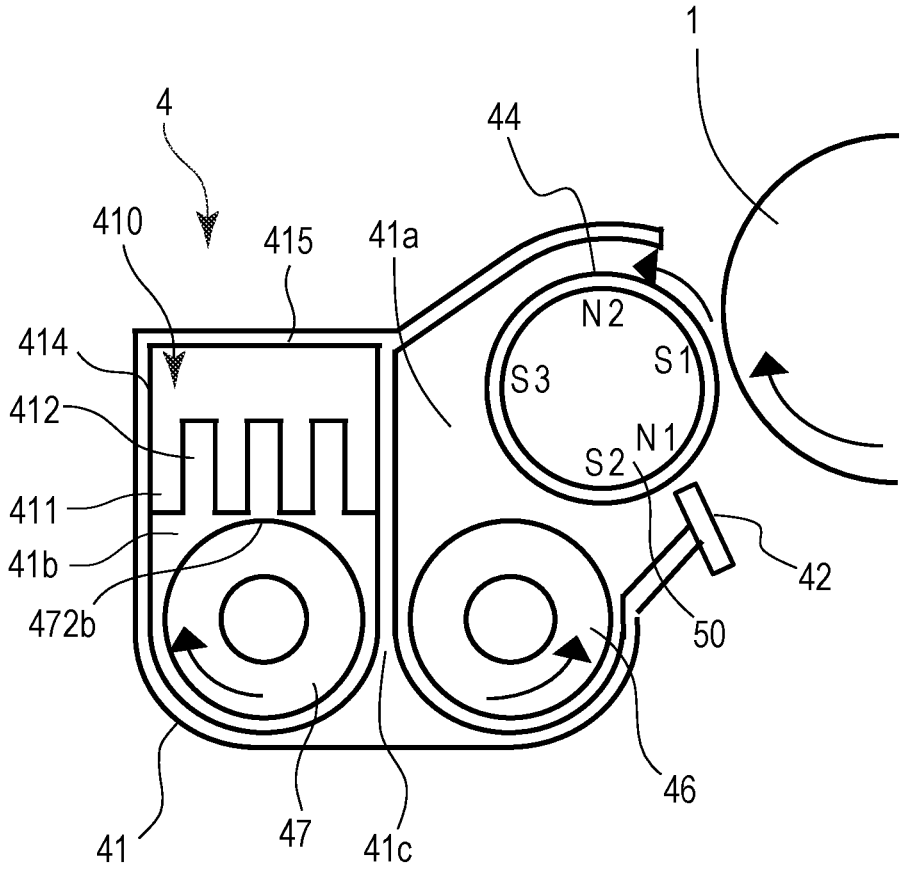
FIG. 5 is a cross-sectional view of the developing apparatus of the first embodiment as viewed from a downstream side in a first direction.

As illustrated in FIG. 5, the wall member 410 in this embodiment is formed such that the block wall portions 411 are disposed in the width direction with the gaps 412 formed therebetween. As described above, the block wall portions 411 are formed so as to block airflow. On the other hand, the gaps 412 are formed so as to cause developer to enter the gaps 412 according to the surface level of the developer conveyed with the rotation of the stirring screw 47.

A carrier is replenished together with a toner as a replenishing agent and hence, with a higher image ratio of an image to be formed on a recording material, a larger amount of carrier is replenished per unit number of sheets. Accordingly, for example, in the case where an image with a high image ratio is continuously formed on recording materials, a developer amount (mainly carrier amount) in the developer container increases with the replenishment of a replenishing agent so that the level of a developer surface increases gradually. In the conventional technique, as described previously, when the level of a developer surface increases, there may be a situation where the developer surface becomes higher in level than a lower end of a wall so that the developer interferes with the wall. Such interference causes the developer to easily accumulate on the wall and hence, there is a possibility that developer is prevented from being smoothly discharged through the discharge port 43, thus excessively increasing a developer amount in the developer container. The excessively large developer amount in the developer container causes the overflow of developer or a load error or the like with the stirring screw 47 due to an increase in drive torque. Accordingly, such a large developer amount is not preferable.

In view of the above, the gaps 412 are formed on the wall member 410 in this embodiment so as to allow developer to enter the gaps 412. To allow developer to pass through the gaps 412 toward the downstream side (discharge port side), the gaps 412 are formed with a uniform size from the upstream end 410*a* to the downstream end 410*b* of the wall member 410 (see FIG. 4). For example, as illustrated in FIG. 5, three gaps 412 are formed on the wall member 410. When the width of the stirring chamber 41*b* is set to 28 mm, for example, the length of each block wall portion 411 and the length of each gap 412 in the width direction may be set substantially equal to each other (approximately 4 mm, for example). Further, the height of each block wall portion 411 and the height of each gap 412 in the vertical direction may also be set substantially equal to each other (approximately 10 mm, for example). It is preferable that the gaps 412 are formed so as to occupy 10 to 30% of the area in the stirring chamber 41*b* ranging from the upper end portion 472*b* of the stirring screw 47 to the upper wall portion 415 of the developer container 41, for example.

As described above, the wall member 410 is provided so as to overlap with at least the peak region between the downstream end 471*a* of the screw 471 and the upstream end 472*c* of the reverse screw 472 as viewed from above in the vertical direction (see FIG. 4). As indicated by a broken line E in FIG. 4, in the peak region, the surface level of developer easily rises beyond the lower end portion 410*c* of the wall member 410. In such a case, a portion of the developer enters the gaps 412 formed on the wall member 410 (see FIG. 5). The developer which enters the gaps 412 is pushed by developer conveyed by the screw 471, thus reaching the downstream side (discharge port side) without accumulating due to the block wall portions 411. In other words, the wall member 410 is formed by disposing the plurality of block wall portions 411 with the gaps 412 and hence, spaces extending in the direction along which the screw 471 conveys developer are formed, and a portion of the developer can reach the downstream side through such spaces when the level of a developer surface becomes high. With such a configuration, even when the wall member 410 is provided, conveyance of developer is not prevented compared to a conventional technique and hence, accumulation of developer can be reduced.

When developer enters the gaps 412, the block wall portions 411 disposed adjacent to the gaps 412 can block airflow in cooperation with the developer entering the gaps 412. That is, in a state where the gaps 412 are almost filled with developer, the developer filling the gaps 412 substantially acts as a wall which prevents the flow of the airflow A. Accordingly, such a configuration can suppress that developer on the airflow flows to the downstream side (discharge port side).

Figure 6:
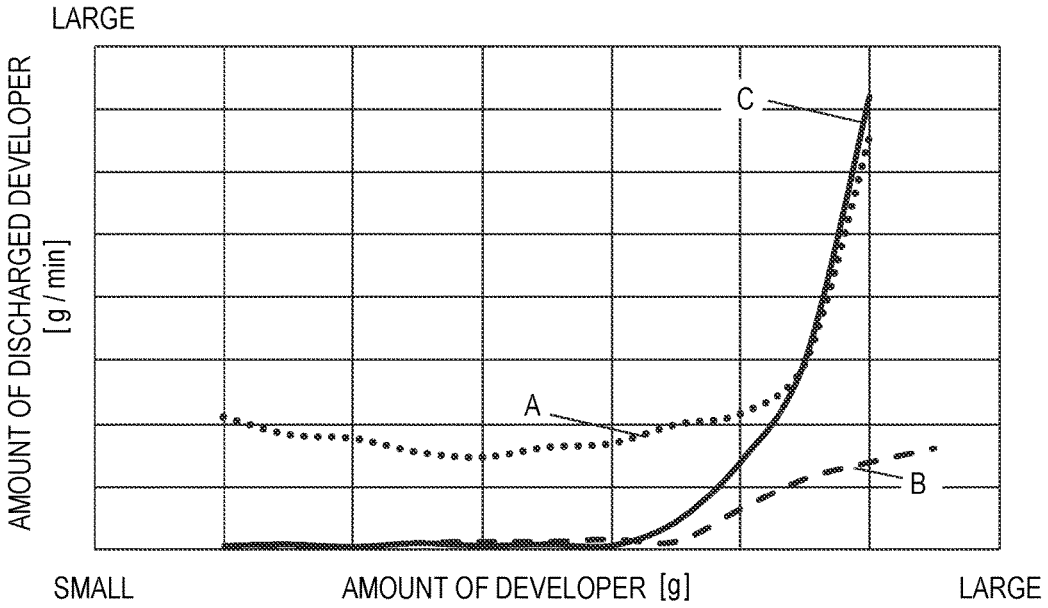
FIG. 6 is a graph showing amounts of discharged developer in this embodiment and a comparative example.

In this embodiment, an experiment was performed on a discharge characteristic of developer to be discharged through the discharge port 43 by comparing a case of using the above-mentioned wall member 410 with a case of using a comparative example. A comparative example 1 is a case where no wall is provided, and a comparative example 2 is a case where a wall having no gap is provided as in the case of the conventional technique. Results of the experiment are illustrated in FIG. 6. A developer amount in the developer container is taken on an axis of abscissas in FIG. 6, and an amount of discharged developer per unit time is taken on an axis of ordinates in FIG. 6. In FIG. 6, a dotted line A indicates a discharge characteristic in the comparative example 1, a dotted line B indicates a discharge characteristic in the comparative example 2, and a solid line C indicates a discharge characteristic in this embodiment.

As can be understood from FIG. 6, in the case of the comparative example 1 (dotted line A), it is understood that when a developer amount is small, developer is discharged more compared to other examples. This is because no wall is provided so that airflow cannot be blocked whereby the developer is conveyed to the discharge port side on the airflow, and is discharged. As described previously, airflow is generated regardless of a developer amount in the developer container and hence, even when a developer amount is small, developer may be discharged in the comparative example 1. In the case of the comparative example 2 (dotted line B), it is understood that when a developer amount is small, developer is prevented from being easily discharged compared to the comparative example 1. This is because airflow is blocked by the wall and hence, there is no possibility that developer on the airflow is conveyed to the discharge port side. However, in the case of the comparative example 2, it is understood that developer discharge performance when a developer amount is increased is lower than that in other examples. This is because, as described previously, when the surface level of the developer is increased due to the increase in developer amount, the developer interferes with a wall so that the developer easily accumulates.

On the other hand, in the case of this embodiment (solid line C), when a developer amount is small, developer is prevented from being easily discharged compared to the comparative example 1, while when a developer amount is large, a larger developer amount is easily discharged compared to the comparative example 2. That is, this embodiment can realize both of the suppression of excessive discharge of developer due to airflow when the developer amount is small and the reduction of accumulation of developer when the developer amount is large.

As has been described above, in this embodiment, the wall member 410 includes the plurality of block wall portions 411 which block airflow generated with the rotation of the stirring screw 47, and the block wall portions 411 are formed with the gaps 412 therebetween. The block wall portions 411 block airflow and hence, it is possible to suppress the discharge of developer through the discharge port 43 due to airflow. When a developer amount is increased, the developer can reach the downstream side (discharge port side) through the gaps 412 and hence, there is no possibility that the discharge of developer through the discharge port 43 is obstructed. As described above, with the use of the wall member 410 in this embodiment in an image forming apparatus of an ACR type, it is possible to realize the suppression of the discharge of developer through the discharge port 43 due to airflow generated with the rotation of the screw, and the reduction of accumulation of developer conveyed by the screw.

Second Embodiment

A second embodiment is described with reference to FIG. 7A to FIG. 8. In suppressing the above-mentioned discharge of developer due to airflow, advantageous effects can be easily acquired by increasing block wall portions 411 in size so as to reduce the size of gaps 412. That is, advantageous effects can be easily acquired by increasing the area which blocks airflow. However, with the reduction in size of the gaps 412, the possibility is increased that the discharge of developer is obstructed when the developer amount is large. In view of the above, the second embodiment adopts the configuration where the height of the gaps 412 in the vertical direction differs between the upstream side and the downstream side. However, other configurations and the manner of operation are substantially equal to those in the first embodiment. Accordingly, in the description made hereinafter, configurations substantially equal to the configurations in the first embodiment are given the same symbols, and the description of such configurations is omitted or simplified. The configurations which make this embodiment different from the first embodiment are mainly described.

Figure 7A:
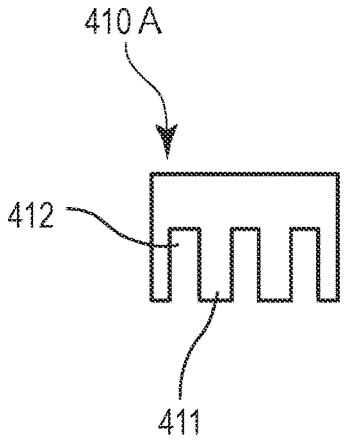
Figure 7B:
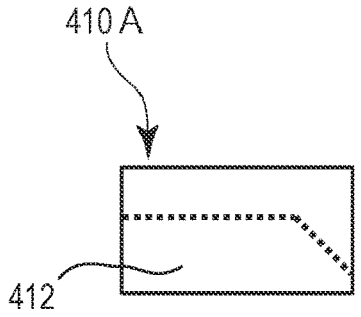
Figure 7C:
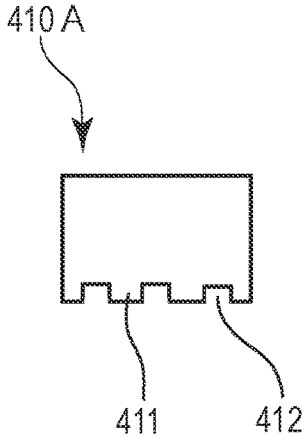
Figure 8:
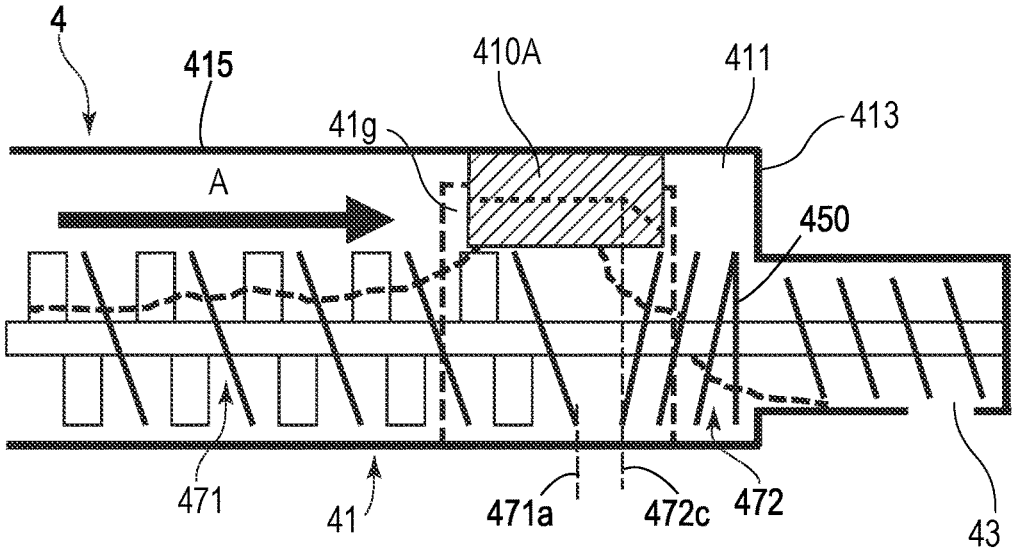
FIG. 8 is a schematic view illustrating an area in the vicinity of a first communication port when a developing apparatus of the second embodiment is viewed from the stirring chamber side.

As illustrated in FIG. 7A and FIG. 7C, a wall member 410A in this embodiment is formed such that the height of the gaps 412 in the vertical direction is lower on the downstream end side (FIG. 7C) than on the upstream end side (see FIG. 7A). The gaps 412 are formed so as to be inclined from a middle portion of the gaps 412 such that the height of the gaps 412 in the vertical direction is lower on the downstream side than on the upstream side (see FIG. 7B). As illustrated in FIG. 8, the start position of such an inclination is at an upstream end 472*c* of a reverse screw 472. That is, the wall member 410A is formed such that the height of the gaps 412 in the vertical direction is reduced on the downstream side of an upstream end 472*c* of a reverse screw 472. The gaps 412 are not limited to be formed in an inclined manner, and may be formed in a stepwise manner. However, forming the gaps 412 in an inclined manner is preferable in view of developer discharge performance.

As has been described above, in the case of this embodiment, the height of the gaps 412 in the vertical direction is high on the upstream side of the upstream end 472*c* of the reverse screw 472 which includes a peak region, while the height of the gaps 412 in the vertical direction is reduced on the downstream side of the upstream end 472*c* of the reverse screw 472 which falls outside the peak region. With such a configuration, airflow can be blocked as much as possible in a region which falls outside the peak region, that is, in a region where the surface level of developer is lower than that in the peak region, while accumulation of developer in the peak region is reduced. That is, in the same manner as the above-mentioned first embodiment, it is possible to realize the suppression of the discharge of developer through a discharge port 43 due to airflow generated with the rotation of the screw, and the reduction of accumulation of developer conveyed by the screw.

Third Embodiment

A third embodiment is described with reference to FIG. 9. The above-mentioned second embodiment adopts the configuration where the height of the gaps 412 in the vertical direction differs between the upstream side and the downstream side. However, the third embodiment adopts a configuration where the height of gaps 412 in the vertical direction differs between the center side in the width direction and the end portion sides in the width direction. However, other configurations and the manner of operation are substantially equal to those in the first embodiment. Accordingly, in the description made hereinafter, configurations substantially equal to the configurations in the first embodiment are given the same symbols, and the description of such configurations is omitted or simplified. The configurations which make this embodiment different from the first embodiment are mainly described.

Figure 9:
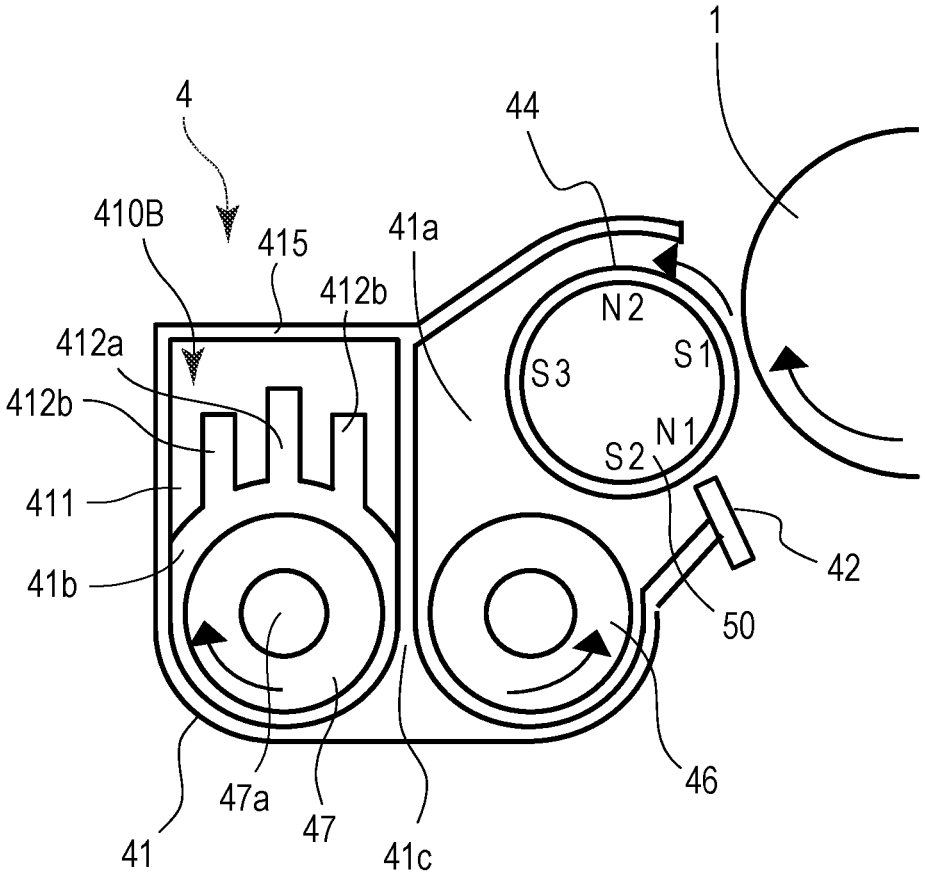
FIG. 9 is a cross-sectional view of a developing apparatus of a third embodiment as viewed from the downstream side in a first direction.

As illustrated in FIG. 9, in a wall member 410B in this embodiment, a lower end of each block wall portion 411 in the vertical direction is formed into an arc shape so as to extend along a peripheral surface of a rotary shaft 47*a* of a stirring screw 47 in the width direction. That is, in the case of this embodiment, the block wall portions 411 are formed such that a distance between a lower surface of each block wall portion 411 in the vertical direction and the stirring screw 47 is substantially uniform in the circumferential direction. The wall member 410B in this embodiment is formed such that the wall member 410B has a plurality of gaps 412*a*, 412*b* in the width direction, and the height in the vertical direction of the gap 412*a* at the center in the width direction is higher than the height in the vertical direction of the gaps 412*b* at the end portion sides in the width direction. This is because the surface level of developer conveyed by the stirring screw 47 is not uniform in the circumferential direction. The surface level of the developer becomes the highest at the upper end portion 472*b* at the center in the width direction, and becomes lower at the end portion sides in the width direction than that at the center in the width direction. Further, the height of the gaps 412*a* in the vertical direction is higher than the surface level of developer when the developer amount in the developer container assumes the maximum allowable amount. With such a configuration, accumulation of developer is prevented from easily occurring even with a large developer amount.

As described above, in this embodiment, the heights of the gaps 412*a*, 412*b* in the vertical direction are varied according to the surface level of developer in the circumferential direction of the stirring screw 47. With such a configuration, it is possible to reduce accumulation of developer at a portion where accumulation of the developer easily occurs due to the high surface level of the developer. Further, airflow can be blocked at a portion where the surface level of developer is low. That is, in the same manner as the above-mentioned first embodiment, it is possible to realize the suppression of the discharge of developer through a discharge port 43 due to airflow generated with the rotation of the screw, and the reduction of accumulation of developer conveyed by the screw.

Another Embodiment

In the above-described respective embodiments, the cases have been exemplified where the gaps 412 do not reach the upper wall portion 415 of the developer container 41 (see FIG. 5, for example). However, the present invention is not limited to such configurations, and the gaps 412 may reach the upper wall portion 415.

In the above-described respective embodiments, the cases where the discharge port 43 is formed on the downstream of the stirring chamber 41*b* in the first direction have been described as an example. However, the present invention is not limited to such configurations. The discharge port 43 may be formed on the downstream of the developing chamber 41*a* in the second direction. In such a case, a reverse screw is disposed on the downstream side of the developing screw 46 in the second direction and hence, the wall member 410 is provided on the downstream of the developing chamber 41*a* in the second direction.

In the above-described respective embodiments, the configuration where the disk shaped member 450 is disposed on the downstream side of the reverse screw 472 has been described as an example. However, the disk shaped member 450 may not be disposed. Further, the configuration where the discharge screw is disposed in the discharge unit 473 has been described as an example (see FIG. 2). However, the discharge screw may not be disposed. In such a case, it is sufficient to set a distance from the downstream end 472*a* of the reverse screw 472 to the discharge port 43 shorter than that in the case where the discharge screw is disposed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-242136, filed Dec. 18, 2017, which is hereby incorporated by reference herein in its entirety.

What is claimed is:

1. A developing apparatus comprising:

a developer carrier configured to carry developer;

a developer container having a first chamber and a second chamber which forms a circulation passage for the developer in cooperation with the first chamber;

a first conveying member provided in the first chamber, and including a first conveying unit and, on a downstream side in a first direction, a reverse conveying unit, the first conveying unit being configured to convey the developer in the first direction, and the reverse conveying unit being configured to convey the developer in a second direction opposite to the first direction;

a second conveying member provided in the second chamber, and configured to convey the developer in the second direction;

a discharge unit provided in the first chamber at a position on a downstream side of the reverse conveying unit in the first direction, and configured to discharge the developer;

a partition wall having a first communication port and a second communication port, and configured to partition the first chamber and the second chamber, the developer being delivered from the first chamber to the second chamber through the first communication port, and the developer being delivered from the second chamber to the first chamber through the second communication port; and a plurality of protruding portions provided so as to oppose the first conveying member at a position above a region between the first conveying unit and the reverse conveying unit in a vertical direction, each of the protruding portions extending along the first direction, wherein the plurality of protruding portions are arranged in a row in a direction orthogonal to the first direction.

2. The developing apparatus according to claim 1, wherein the first conveying member is disposed such that a downstream end of the first conveying unit and an upstream end of the reverse conveying unit in the first direction are positioned between an upstream end and a downstream end of the first communication port in the first direction.

3. The developing apparatus according to claim 1, wherein a height of a gap in the vertical direction formed between the plurality of protruding portions is lower on a downstream side than on an upstream side in the first direction.

4. The developing apparatus according to claim 1, wherein the second chamber is disposed lower than the developer carrier in the vertical direction so as to supply the developer to the developer carrier.

5. The developing apparatus according to claim 1, wherein the first chamber is disposed at a position adjacent to the second chamber in a horizontal direction.

6. The developing apparatus according to claim 1, wherein an upstream end and a downstream end of each of the protruding portions in the first direction is disposed at a position which opposes the first communication port.

7. The developing apparatus according to claim 1, wherein an upstream end of each of the protruding portions in the first direction is disposed above the first conveying unit in the vertical direction.

8. The developing apparatus according to claim 1, wherein a downstream end of each of the protruding portions in the first direction is disposed above the reverse conveying unit in the vertical direction.

9. The developing apparatus according to claim 1, wherein a height of a gap in the vertical direction formed between the plurality of protruding portions is lower than a height of a ceiling of the developer container which opposes the first conveying member on an upstream side of the plurality of protruding portions in the first direction.

10. The developing apparatus according to claim 1, wherein the plurality of protruding portions are provided on a ceiling of the developer container.

* * * * *